United States Patent [19]

Wieczerniak

[11] Patent Number: 5,022,938

[45] Date of Patent: Jun. 11, 1991

[54] METHOD FOR PREPARING CORROSION-RESISTANT ZINC-COBALT SURFACES

[75] Inventor: Walter J. Wieczerniak, Utica, Mich.

[73] Assignee: OMI International Corporation, Warren, Mich.

[21] Appl. No.: 385,562

[22] Filed: Jul. 31, 1989

[51] Int. Cl.[5] ..... C23C 23/26

[52] U.S. Cl. ..... 148/267; 148/264; 148/244

[58] Field of Search ..... 148/267, 244, 264

[56] References Cited

U.S. PATENT DOCUMENTS

| | | | |
|---|---|---|---|
| 2,393,640 | 1/1946 | King | 148/267 |
| 2,599,812 | 7/1951 | Watson | 148/267 |

FOREIGN PATENT DOCUMENTS

| | | | |
|---|---|---|---|
| 0185777 | 10/1983 | Japan | 148/264 |
| 0202083 | 9/1987 | Japan | 148/267 |

*Primary Examiner*—Sam Silverberg
*Attorney, Agent, or Firm*—Richard P. Meuller

[57] ABSTRACT

The present invention relates to compositions and methods for providing a corrosion-resistant coating on a zinc-cobalt alloy surface said surface with a hexavalent chromium-containing treatment solution. In a preferred embodiment, the solution comprises:

(a) about 2 to about 30 g/l of $CrO_3$;

(b) 0 to about 25 g/l of dichromate ion such that the total $Cr^{+6}$ is about 1 to about 35 g/l;

(c) about 0.5 to about 20 g/l of $NH_4^+$; and (d) about 5 to about 30 g/l of formate ion.

The solution additionally comprises:

(e) about 2 to about 25 g/l of $Cl^-$; and has a pH controlled by the addition of HCl or NaOH of about 0.8 to about 2.5. The solution is substantially-free of sulfate, chlorate and nitrate. In one embodiment, the formate is optional and low levels of $Cr^{+6}$ are employed.

15 Claims, No Drawings

METHOD FOR PREPARING CORROSION-RESISTANT ZINC-COBALT SURFACES

BACKGROUND AND SUMMARY OF THE INVENTION

The present invention relates to compositions and methods which are uniquely capable of providing an improved corrosion-resistant chromate coating on zinc-based alloy surfaces, and in particular zinc-cobalt metal surfaces.

Zinc is an extremely popular metal for making and plating metal parts and metal castings. Zinc is especially popular for the plating of metal work pieces, fasteners, and the like. However, while frequently being the metal of choice, zinc is known to rapidly corrode in the presence of moisture. Zinc can rapidly corrode even in the presence of moisture at the fairly low level present in the atmosphere. Further, zinc surfaces do not always provide or maintain the desired esthetic appearance that is required for many commercial applications.

Accordingly, in order to improve or prolong the stable life of a zinc metal surface, and in order to preserve or improve the esthetic appearance of zinc-plated parts, the art has recognized the desirability of providing various protective coatings on zinc-plated parts or zinc surfaces. For example, zinc parts have been passivated in acidic solutions of tri- or hexavalent chromium. Many of the systems employing tri- or hexavalent chromium also require the presence of nitrate, sulfates and/or chlorate ions.

One of the other common art-disclosed methods of improving zinc-metal surfaces is to employ a zinc alloy. However, zinc alloy surfaces, like zinc metal surfaces, likewise corrode under the effects of atmospheric moisture and likewise possess certain aesthetic negatives. Accordingly, such zinc-based metal alloys, such as zinc-aluminum, zinc-copper, zinc-cobalt, zinc-tin, zinc-manganese and zinc-nickel, need to be protected and/or dyed in order to improve their usefulness and/or esthetic appearance. However, because of their varying physical and chemical properties, these various zinc-based alloys provide a host of problems for providing corrosion-resistant coating and dyeing that are unique to each of the specific alloys. This is most commonly and easily demonstrated by noting the observation that certain successful zinc metal coating or dyeing systems function inadequately or fail completely on zinc-cobalt alloys.

The present invention provides compositions and methods which are particularly suited to preserving and/or dyeing zinc-based alloys, particularly zinc-cobalt alloys, under severe conditions.

While there are a variety of systems for coating zinc metal presently disclosed in the art, corrosion performance (typically measured by a neutral salt sprays or Kesternich) of many conversion coatings in use today has been found to be inadequate. While many of these conversion coatings produce adequate protection when subjected to very mildly corrosive environments, the same commonly-employed finishes are unsatisfactory or unacceptable in environments where corrosion is more severe.

Many chromate conversion coatings currently disclosed in the prior art also produce acceptable finishes on zinc-alloy surfaces which perform acceptably under mild conditions. Likewise, however, when applied to zinc alloys such as zinc-cobalt or zinc-nickel, either the corrosion performance is inadequate under severe conditions or their appearance is unacceptable. The performance is not uniformly satisfactorily on all zinc-based alloys.

U.S. Pat. No. 2,393,640 relates to the dyeing of metal surfaces, particularly non-ferrous metals such as zinc, cadmium, and galvanized metal. Dye baths are adjusted to a pH of about 3.0 to about 8.0. The surfaces which are to be dyed are those coated accordingly to U.S. Pat. No. 2,393,663. This latter U.S. Patent discloses an insoluble adherent corrosive-resistant coating for zinc and cadmium surfaces, particularly galvanized metal. There is no teaching or suggestion of the use of these materials on zinc-based alloys such as zinc-cobalt.

U.S. Pat. No. 2,796,369 discloses the use of a hexavalent chromium compound in combination with nitric acid and octyl alcohol in order to treat zinc-copper alloys.

U.S. Pat. No. 2,859,144 teaches the use of hexavalent chromium solutions, also containing ammonium chloride and $HBF_4$, in the treatment of aluminum and aluminum alloy surfaces.

U.S. Pat. No. 2,116,176, teaches a process for producing a white-, scratch-, moisture- and corrosion-resistant coatings on zinc- and cadmium-clad surfaces by employing chromic acid solutions. This patent teaches that chromic acid solutions which contain about 30% of chlorine ions, measured by weight on the weight of the chromic acid present. The suggested pH range is between 2 and 3, and preferred stabilizers include potassium nitrate and/or potassium chlorate. It is suggested that the treatment with these chromic acid solutions is preferably carried out at the boiling temperature of the treatment.

U.S. Pat. No. 3,553,034, discloses a process for providing a corrosion-resistant passivation film on a zinc surface wherein the surface is treated with an aqueous solution of a chromic acid wherein part of the hexavalent chromium in the solution is reduced to or replaced by trivalent chromium. This reference teaches that the pH must be maintained in the range of 2.8 to 3.0 by the inclusion of pH control agents. One suggested method of reducing the hexavalent chromium to trivalent chromium is a suggestion that the hexavalent chromium be reacted with formaldehyde. There is no teaching or suggestion of the use of these solutions on zinc-based alloys, such as zinc-cobalt.

U.S. Pat. No. 3,755,081, discloses compositions and processes for inhibiting corrosion of non-ferrous metal surfaces. The compositions and methods are alleged to be chromate depositing solution which have solids content in the range of 0.2 grams per liter to 75 grams per liter. They require inclusion of a large variety of materials, including fluoboric acid and/or fluosilicic acid, in sufficient quantities to enhance adherency of the resulting surface to an organic film-forming polymer.

U.S. Pat. No. 3,816,142, discloses the treatment of a zinc electroplated article with treatment solutions comprising aqueous baths containing sodium dichromate, sodium nitrate, formic acid, acetic acid and having a final pH of 2.1 to 2.7.

U.S. Pat. No. 3,880,772, discloses a hexavalent-chromium containing zinc passivation system employing nitric acid and its salts.

U.S. Pat. No. 4,238,250, discloses a method of producing a multi-colored decorative zinc or zinc alloy surface. The compositions employed in these methods appear to be particularly suited to the treatment of zinc-/aluminum alloy and employ sulfates.

Accordingly, there exists a need for a chromating solution which consistently produces coatings on zinc-cobalt surfaces having improved corrosion performance under even extreme conditions while at the same time providing esthetically-acceptable appearance upon this specific alloy composition. It should be noted that color, and the ability to assemble a composition which allows the skilled artisan to select a specific coating color that will retain its corrosion-resistant properties, is extremely important for a zinc-cobalt surface. The esthetically-acceptable appearance can be achieved from compositions which either provide the esthetically-pleasing appearance themself, or which are capable of being indirectly improved by dyeing.

Accordingly, it is readily appreciated by the art that the zinc alloy deposits, particularly zinc-cobalt alloys, have typically been found to be more corrosion resistant than zinc surfaces themselves. It is known that this corrosion resistance is enhanced even further when these deposits are coated with a chromium-containing conversion coating. It has now been observed that this corrosion resistance may be further enhanced when these deposits are coated with chromate conversion coatings which provide thicker coatings, by including select art-disclosed components and by eliminating certain art-disclosed components.

The present invention relates to compositions and methods for providing a corrosion-resistant coating on a zinc-cobalt alloy surface with a hexavalent-chromium-containing treatment solution. In a preferred embodiment, the solution comprises (a) about 2 to about 40 g/l of $CrO_3$ and (b) 0 to about 35 g/l of dichromate ion; such that the total $Cr^{+6}$ is about 1 to about 35 g/l. It further employes (c) about 0.5 to about 20 g/l of $NH_4^+$, (d) about 5 to about 30 g/l of formate ion, and (e) about 2 to about 25 g/l of $Cl^-$. The final solution has a pH controlled by the addition of HCl or NaOH in the range of about 0.8 to about 2.5. The solution is substantially-free of sulfate, chlorate and nitrate. In one embodiment, the formate is optional and low levels of $Cr^{+6}$ are employed Other art-disclosed additives such as color enhancers may also be employed.

DETAILED DESCRIPTION OF THE INVENTION

The present invention represents improved compositions and methods for providing corrosion-resistant coatings upon specific alloy surfaces. In particular, the compositions and methods of the present invention are particularly suited to providing a corrosion-resistant coating or treatment for zinc-cobalt surfaces; they are most highly suited to zinc-cobalt alloy surface wherein the cobalt is present at a level of about 0.05 to about 2%, by weight of the alloy, with the balance being zinc.

The compositions and methods of the present invention employ hexavalent chromium ($Cr^{+6}$, Cr VI), preferably in an aqueous solution. The hexavalent chromium can be supplied from any convenient source, but at least a portion of it must be supplied from chromium trioxide (chromium VI oxide; $CrO_3$)

The preferred level of hexavalent chromium employed in the compositions and methods of the present invention is in the range of about 1 to about 35 grams per liter (g/l). More preferably, the hexavalent chromium is present at a level of about 5 to about 30 g/l, and still more preferably about 7 to about 20 g/l.

As noted above, at least a portion of the hexavalent chromium must come from chromium VI oxide, $CrO_3$. Preferably, the chromium VI oxide is employed at a level of about 4 to about 40 g/l, more preferably about 10 to about 40 g/l, and still more preferably about 20 to about 40 g/l.

A second preferred albeit optional source of hexavalent chromium is the dichromate ion. Preferred sources include sodium and potassium salts. Sodium dichromate, $Na_2Cr_2O_7$, especially the hydrated salt, $Na_2Cr_2O_7 \cdot 2H_2O$, are highly preferred. The dichromate ion is preferably employed at a level of about 5 to about 25 g/l. However, as noted above, other chromium salts may be employed, such as the potassium salts.

Another required component of the compositions and methods of the present invention is ammonium ion. This can be provided from any convenient source, but is preferably provided by $NH_4Cl$. The ammonium ion is preferably present at a level of about 0.5 to about 20 g/l. More preferably, the treatment compositions and methods of the present invention employ $NH_4^+$ at a level of about 0.5 to about 10 g/l, still more preferably about 1 to about 7 g/l, and still more preferably about 3 to about 7 g/l. $NH_4Cl$ is a preferred source of $NH_4^+$ in that it also provides the necessary chloride ions, as discussed below.

Another optional but preferred component of the compositions and methods of the present invention is formate ion, $HCOO^-$. This may be supplied from any convenient source. Preferred sources include the sodium, potassium and ammonium salts as well as formic acid. Sodium formate, HCOONa, is highly preferred. When employed, the formate ion is preferably present at a level of about 5 to about 30 g/l, more preferably about 10 to about 30 g/l, and still more preferably about 13 to about 30 g/l. As can be seen from Example VI, sodium formate is only optional when a brown or other dark coating color is necessary or desired. Further, if such a brown or dark color is desirable, and the formate is not included, low levels of hexavalent chromium must be employed. Accordingly, when formate is absent from the compositions and methods of the present invention, levels of $Cr^{+6}$ are preferably about 2 to about 15 g/l, and more preferably about 5 to about 10 g/l, are employed.

Another component of the treatment compositions and methods of the present invention is chloride ion, $Cl^-$. The chloride ion can be supplied from any convenient source such as HCl, $NH_4Cl$, NaCl, KCl, and the like; chloride ion is preferably present at a level of about 2 to about 25 g/l.

As noted above, it has been discovered that certain ions that are commonly employed in the chromate treatment of zinc surfaces generally can be detrimental to the current compositions and methods designed for the treatment of zinc-cobalt surfaces. In particular, these ions are sulfate, nitrate and chlorate. Accordingly, the compositions and methods of the present invention are substantially free of these ions. In a preferred embodiment, the compositions and methods of the present invention, contain levels of these ions below that which will visibly interfere with the color of function of the resulting chromate coating. In a highly preferred embodiment, the compositions and methods of the present invention contain less than about 0.5 percent (by weight) sulfate, 0.025 percent chlorate and 0.15 percent nitrate. Still more preferably, the compositions and methods of the present invention contain less than about 0.005 sulfate; 0.005 percent chlorate; and 0.05 percent nitrate. It will be appreciated that such "substantially-free" values are generally established to account for the purity levels of available technical grade reagents that are typically available for commercial processes.

The pH of the treatment compositions and methods of the present invention is preferably about 0.8 to about 2.5, more preferably about 1 to about 1.5. It is highly preferred that the pH be controlled by employing HCl if a lower pH is necessary, or NaOH if raising the pH is necessary. Controlling pH by employing HCl provides part or all of the necessary chloride ion without introducing any other ions which could potentially interfere with the final coating or deposit.

The treatment solutions of the present invention are preferably employed at about 70° F. to about 90° F., and more preferably about 75° F. to about 85° F.

All of the above ions, can be measured by any convenient and reliable method; such methods are well known to the skilled artisan. For example, the "Metal Finishing Guidebook & Directory," 1989, published by Metals & Plastics Publications, Inc., provides convenient and reliable methods for measuring $Cr^{+6}$ (p. 559); $NH_4^+$ (p. 561); and $Cl^-$ (p. 571); all of which methods are expressly incorporated herein bY reference. Formate may be measured, for example, by the method disclosed in "Analysis of Electroplating and Related Solutions", K. E. Langford; 3rd Ed.; published by Robert Draper Ltd.; p. 128, 129; also expressly incorporated herein by reference.

Another optional component of the compositions and methods of the present invention are other color enhancers, such as acetic acid, sodium acetate, potassium acetate, citric acid, and the like. These may be typically employed at a level of about 1 to about 70 g/l.

In order to further illustrate the process of the present invention, the following specific examples are provided. It will be understood that the examples as hereinafter set forth are provided for illustrative purposes and are not intended to be limiting of the scope of this invention as herein disclosed and as set forth in the subjoined claims.

EXAMPLE I

Zinc alloy deposits particularly Zn/Co have been found to be more resistant to corrosion than zinc. Corrosion resistance is enhanced even further when these deposits are coated with a chromate conversion coating with the best performance being obtained with the thicker coatings, e.g., bronzes, browns or olive-drabs. Black coatings can be obtained by subjecting a brown or olive-drab conversion coating to a dyeing process. Parts plated with zinc-cobalt alloys and coated with brown or olive-drab conversion coatings were able to withstand more than 150–180 hours of testing in neutral salt spray to 5% white corrosion. These conversion coatings were obtained by treating the zinc-cobalt alloy electrodeposits in the following solutions and conditions:

| | | |
|---|---|---|
| $CrO_3$ | 10–40 g/l | Time 1–3 min. |
| $Na_2Cr_2O_7\ 2H_2O$ | 6.75–27 g/l | Temp. 75° F. |
| $NH_4Cl$ | 5–20 g/l | |
| NaOOCH | 1–40 g/l | |
| pH | 1–1.5 | |

Satisfactory conversion coatings were obtained on alloys where cobalt content ranged from 0.05–2%.

Also, yellow or bronze corrosion resistant coatings may be obtained for zinc-cobalt alloys. Such coatings can be obtained best from ammonium chloride containing chromates which may contain either sodium or potassium chlorides and making the formate ion optional.

EXAMPLE II

Approximately 1000 gms of steel screws were placed in a plating barrel and plated at 6 asf for 45 minutes in a zinc-cobalt electrolyte. The deposit was found to contain 0.64% cobalt. A portion of the load was then immersed in a chromating solution of the following composition and conditions:

| | | |
|---|---|---|
| $CrO_3$ | 20 g/l | Time 1 min. |
| $Na_2Cr_2O_7\ 2H_2O$ | 13.5 g/l | Temp. 75° F. |
| $NH_4Cl$ | 10 g/l | |
| NaOOCH | 20 g/l | |
| pH | 1.2 (apprx.-adjusted with HCl) | |

After immersion the parts were rinsed in water and either dried or dyed. Coatings were uniformly brown and dyed easily to a uniform black color. Parts withstood 170 hours of testing neutral salt spray to 5% white corrosion.

EXAMPLE III

Another portion of the above load of Example II was immersed in another chromate of the following composition and conditions:

| | | |
|---|---|---|
| $CrO_3$ | 10 g/l | Time 1 min. |
| $N6_2Cr_2O_7\ 2H_2O$ | 6.75 g/l | Temp. 80° F. |
| $NH_4Cl$ | 5 g/l | |
| NaOOCH | 10 g/l | |
| pH | 1.0 (apprx.-adjusted with HCl) | |

After immersion the plate is rinsed in water and either dried immediately or dyed black, rinsed again and dried. Coatings were uniformly brown and dyed easily to a uniform black color. Parts were subjected to testing in neutral salt spray and withstood approximately 160 hours to 5% white corrosion.

EXAMPLE IV

Another portion of the above load of Example II was immersed in another chromate of the following composition and conditions:

| | | |
|---|---|---|
| $CrO_3$ | 40 g/l | Time 1 min. |
| $Na_2Cr_2O_7\ 2H_2O$ | 27 g/l | Temp. 70° F. |
| $NH_4Cl$ | 20 g/l | |
| NaOOCH | 40 g/l | |
| pH | 1.4 (apprx.-adjusted with HCl) | |

After immersion the plate is rinsed in water and either dried immediately or dyed black, rinsed again and dried. Coatings were uniformly brown and dyed easily to a uniform black color. Parts were subjected to testing in neutral salt spray and withstood approximately 170 hours to 5% white corrosion.

EXAMPLE V

Another load (1000 gms) of screws were plated in a zinc-cobalt electrolyte at 6 ASF for 45 minutes. The alloy contained 0.93% Cobalt.

A portion of the load was then immersed in a chromating solution of the following composition and conditions:

| | | |
|---|---|---|
| $CrO_3$ | 20 g/l | Time 1 min. |
| $Na_2Cr_2O_7$ $2H_2O$ | 13.5 g/l | Temp. 78° F. |
| $NH_4Cl$ | 10 g/l | |
| NaOOCH | 20 g/l | |
| pH | 1.3 (appx.-adjusted with HCl) | |

After immersion the parts were rinsed in water and either dried immediately or dyed black, rinsed again and dried. Coatings were uniformly brown and dyed easily to a uniform black color. Parts were subjected to testing in neutral salt spray and withstood approximately 170 hours to 5% white corrosion.

Also, yellow or bronze corrosion resistant coatings may be obtained for zinc-cobalt alloys by employing the compositions and methods of the present invention. Such coatings can be obtained best from ammonium chloride containing chromate solution which may contain either sodium or potassium chlorides and which employ reduced levels of formate ion, or which are substantially-free of formate.

EXAMPLE VI

A 50 kg size load of small bolts were plated in a commercial barrel operation with a zinc-cobalt alloy, containing 1% cobalt content and the rest zinc. The parts were rinsed and immersed for 30 seconds in a yellow-bronze chromate having the following formulation and conditions:

| | |
|---|---|
| 5 g/l | $CrO_3$ |
| 2.5 g/l | NaCl |
| 2.5 g/l | $NH_4Cl$ |
| 1.4 | pH |
| 80° F. | Temp. |

The resultant coating was hard, lustrous, and adherent and lasted for 270 hours in Neutral Salt Spray (ASTM B117) to 5% white corrosion.

EXAMPLE VII

A treatment solution containing the following was prepared, and contacted with zinc-cobalt alloy parts produced from an air agitation rack bath resulting in 0.55% cobalt content; the contact under the described condition.

| | |
|---|---|
| $CrO_3$ | 20 g/l |
| $Na_2Cr_2O_7$ $2H_2O$ | 13.5 g/l |
| $NH_4Cl$ | 10 g/l |
| $HCOONH_4$ | 23 g/l |
| $CH_3COOH$ | 52 g/l |

-continued

| | |
|---|---|
| pH | 2.5 |
| Time | 1 min. |
| Temperature | 75-85° F. |

After immersion the parts were olive-drab, lustrous, and adherent and provided 300-400 hours corrosion protection in ASTM B117 Neutral Salt Spray Test.

What is claimed is:

1. A method for providing a corrosion-resistant coating on a zinc-cobalt alloy surface, comprising contacting said surface with an aqueous hexavalent-chromium-containing treatment solution comprising:

(a) about 2 to about 40 g/l of $CrO_3$;

(b) 0 to about 25 g/l of dichromate ion; wherein the total $Cr^{+6}$ is in the range of about 1 to about 35 g/l;

(c) about 0.5 to about 20 g/l of $NH_4^+$;

(d) about 5 to about 30 g/l of formate ion;

(e) about 2 to about 25 g/l of $Cl^-$; wherein said treatment solution has a pH in the range of about 0.8 to about 2.5 and is substantially-free of sulfate, chlorate and nitrate.

2. A method according to claim 1 wherein the treatment solution comprises about 10 to about 40 g/l of $CrO_3$.

3. A method according to claim 1 wherein the treatment solution comprises about 20 to about 40 g/l of $CrO_3$.

4. A method according to claim 1 wherein the treatment solution comprises about 5 to about 30 g/l of $Na_2Cr_2O_7 . H_2O$.

5. A method according to claim 1 wherein the treatment solution comprises about 0.5 to about 10 g/l of $NH_4^+$.

6. A method according to claim 1 wherein the treatment solution comprises about 3 to about 7 g/l of $NH_4^+$.

7. A method according to claim 1 wherein the treatment solution comprises about 10 to about 40 g/l of formate ion.

8. A method according to claim 1 wherein the treatment solution comprises about 20 to about 40 g/l of formate ion.

9. A method according to claim 1 wherein the treatment solution has a temperature of about 70° F. to about 90° F. when brought into contact.

10. A method according to claim 1 wherein the treatment solution has a temperature of about 75° F. to about 85° F. when brought into contact.

11. A method according to claim 1 wherein the treatment solution additionally comprises $Na^+$, $K^+$, or mixtures thereof.

12. A method according to claim 1 wherein the alloy surface is a zinc-cobalt comprising cobalt at a level of about 0.05 to about 2 percent, by weight.

13. A method according to claim 1 wherein the pH is in the range of about 1 to about 1.5.

14. A method according to claim 1 wherein the pH is controlled by the addition of HCl or NaOH.

15. A method according to claim 1 wherein the treatment solution additionally comprises acetate ion as a color enhancer.

* * * * *